US009777958B2

(12) United States Patent
Choi et al.

(10) Patent No.: US 9,777,958 B2
(45) Date of Patent: Oct. 3, 2017

(54) REFRIGERATOR

(71) Applicant: LG ELECTRONICS INC., Seoul (KR)

(72) Inventors: Kyukwan Choi, Seoul (KR); Kyusuh Park, Seoul (KR); Sungkyong Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/615,078

(22) Filed: Feb. 5, 2015

(65) Prior Publication Data

US 2015/0233629 A1 Aug. 20, 2015

(30) Foreign Application Priority Data

Feb. 17, 2014 (KR) ..... 10-2014-0017874

(51) Int. Cl.
*A47B 96/04* (2006.01)
*F25D 23/04* (2006.01)
(Continued)

(52) U.S. Cl.
CPC ..... *F25D 23/04* (2013.01); *F25D 23/028* (2013.01); *E05D 7/081* (2013.01); *F25D 23/025* (2013.01);
(Continued)

(58) Field of Classification Search
CPC ..... F25D 23/025
(Continued)

(56) References Cited

U.S. PATENT DOCUMENTS 1,984,977 A 12/1934 Mize
2,046,909 A * 7/1936 Terry ..... F25D 23/04 312/292
(Continued)

FOREIGN PATENT DOCUMENTS

CN 101398248 4/2009
CN 102 252 484 A 11/2011
(Continued)

OTHER PUBLICATIONS

European Search Report dated Sep. 29, 2015 issued in Application No. 15151743.0.
(Continued)

*Primary Examiner* — Matthew Ing
(74) *Attorney, Agent, or Firm* — KED & Associates, LLP

(57) ABSTRACT

Provided is a refrigerator including a cabinet having a storage compartment provided therein, a main door pivotably mounted at the cabinet for opening and closing the storage compartment, an auxiliary storage compartment mounted at a rear of the main door, and an auxiliary door pivotably mounted over a front of the main door for opening and closing the auxiliary storage compartment. A first hinge bracket may be fixed to an upper end of the cabinet, the first hinge bracket including a rotation shaft that is coupled to an upper portion of the main door. A second hinge bracket may be fixed to an upper portion of the sub door, the second hinge bracket including a rotation shaft that is coupled to the upper portion of the main door. The rotation shaft of the second hinge bracket may be positioned more forward than the rotation shaft of the first hinge bracket.

21 Claims, 10 Drawing Sheets

(51) Int. Cl.
*F25D 23/02* (2006.01)
*E05D 7/081* (2006.01)

(52) U.S. Cl.
CPC .... *F25D 2323/024* (2013.01); *F25D 2500/02* (2013.01)

(58) Field of Classification Search
USPC ..... 312/401, 405, 291, 292
See application file for complete search history.

(56) References Cited

U.S. PATENT DOCUMENTS

| | | | | |
|---|---|---|---|---|
| 2,150,064 | A | 3/1939 | Robert et al. | |
| 2,309,001 | A * | 1/1943 | Nave | E05D 3/02 16/379 |
| 3,065,035 | A * | 11/1962 | Biesecker | F16C 11/04 16/273 |
| 3,335,454 | A * | 8/1967 | Danster, Jr. | E05F 1/1215 16/278 |
| 5,431,490 | A * | 7/1995 | Edwards | F25D 23/025 160/184 |
| 2004/0207304 | A1* | 10/2004 | Cho | E05B 1/0015 312/405 |
| 2010/0231110 | A1* | 9/2010 | Choi | E05D 5/02 312/405 |
| 2010/0307188 | A1* | 12/2010 | Kwon | F25D 23/028 62/441 |
| 2012/0062093 | A1* | 3/2012 | Lee | F25D 23/025 312/405 |
| 2013/0026900 | A1* | 1/2013 | Oh | F25D 23/02 312/401 |
| 2013/0119849 | A1 | 5/2013 | Gwak | |
| 2013/0255304 | A1 | 10/2013 | Cur et al. | |
| 2013/0264930 | A1* | 10/2013 | Kim | E05F 1/00 312/404 |
| 2013/0264931 | A1 | 10/2013 | Kwon et al. | |

FOREIGN PATENT DOCUMENTS

| | | | |
|---|---|---|---|
| CN | 103512299 | | 1/2014 |
| JP | S56 164495 | U | 12/1981 |
| JP | S56 174678 | U | 12/1981 |
| KR | 10-0887575 | B1 | 3/2009 |
| WO | WO2009043696 | * | 4/2009 |

OTHER PUBLICATIONS

Chinese Office Action dated Sep. 27, 2016 issued in Application No. 201510040785.X.

* cited by examiner

REFRIGERATOR

CROSS-REFERENCE TO RELATED APPLICATION(S)

This application claims priority under 35 U.S.C. §119 to Korean Patent Application No. 10-2014-0017874, filed on Feb. 17, 2014, which is hereby incorporated by reference as if fully set forth herein.

BACKGROUND

1. Field

The present disclosure relates to a refrigerator including a main door for opening and closing a storage compartment provided in a cabinet and an auxiliary door for opening and closing an auxiliary storage compartment provided at the inside of the main door.

2. Background

Refrigerators including a main door and auxiliary doors are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

In general, a refrigerator is an appliance that reduces the interior temperature thereof using cool air generated by a refrigeration cycle including a compressor, a condenser, an expansion valve, and an evaporator to store foods in a frozen state or in a refrigerated state. The refrigerator may include a freezer compartment for storing foods or beverages in a frozen state and a refrigerator compartment for storing foods or beverages at low temperature.

A refrigerator may be classified as a top mount type refrigerator, in which a freezer compartment is disposed above a refrigerator compartment, a bottom freezer type refrigerator, in which a freezer compartment is disposed under a refrigerator compartment, or a side-by-side type refrigerator, in which a freezer compartment and a refrigerator compartment are partitioned by a partition wall such that the freezer compartment is disposed at the left side of the refrigerator and the refrigerator compartment is disposed at the right side of the refrigerator.

In recent years, the capacity of a refrigerator has been greatly increased. In addition, a door shelf or a receiving case may be provided at the inside of a door so as to form a space for receiving stored goods, thereby efficiently utilizing a receiving space of the refrigerator.

Figure 1:
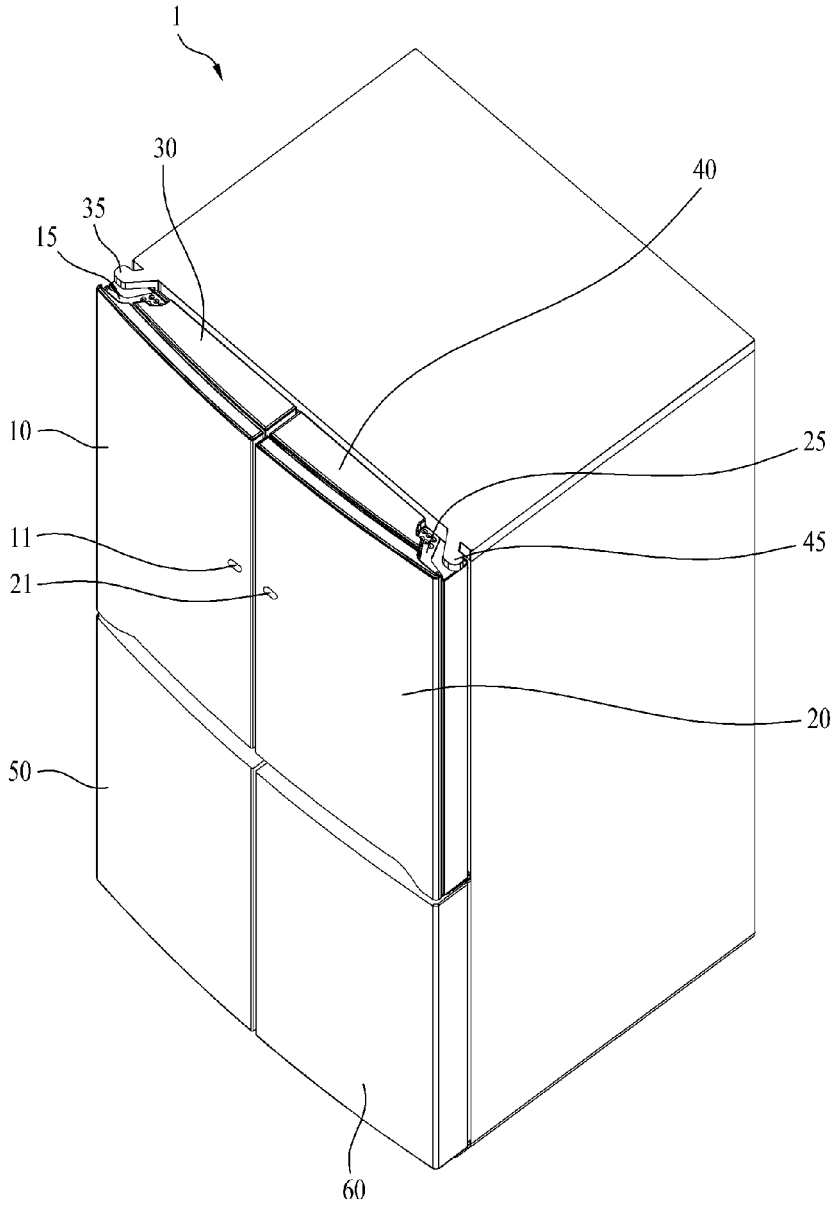
FIG. 1 is a perspective view showing a conventional refrigerator.
Figure 2:
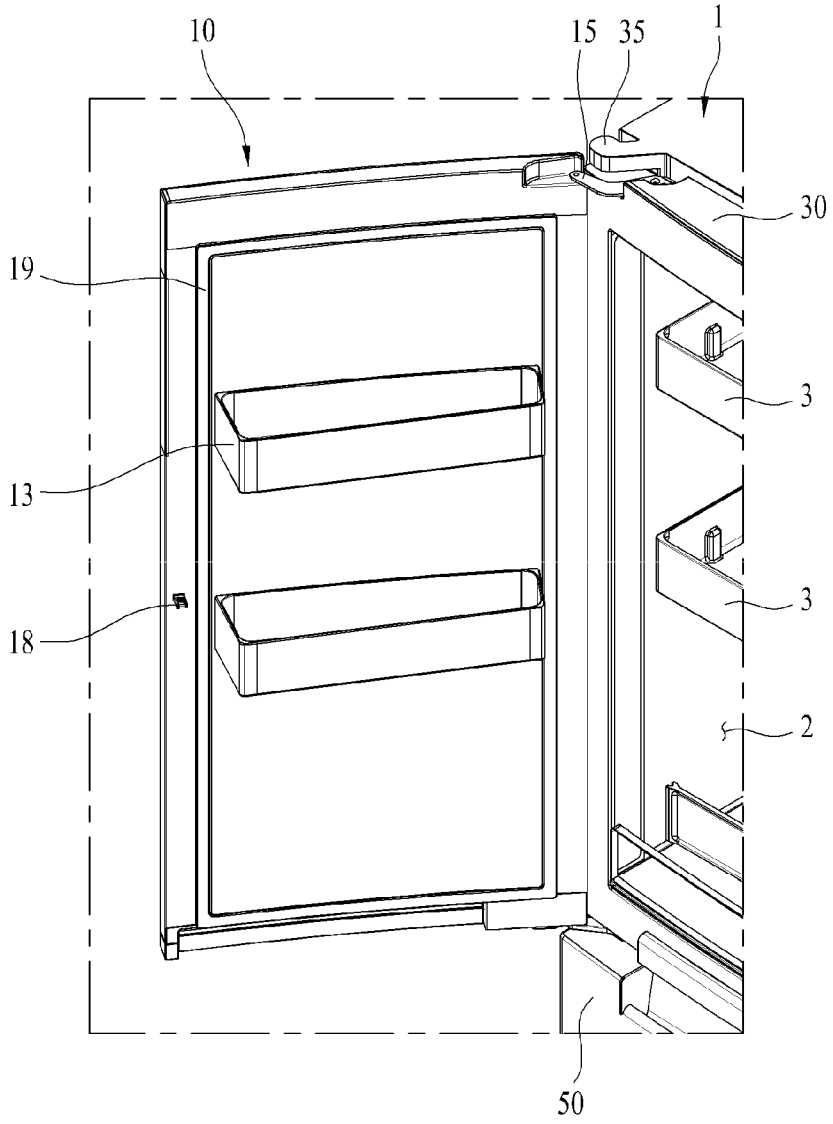
FIG. 2 is a partial perspective view showing a state in which one auxiliary door is opened in FIG. 1.
Figure 3:
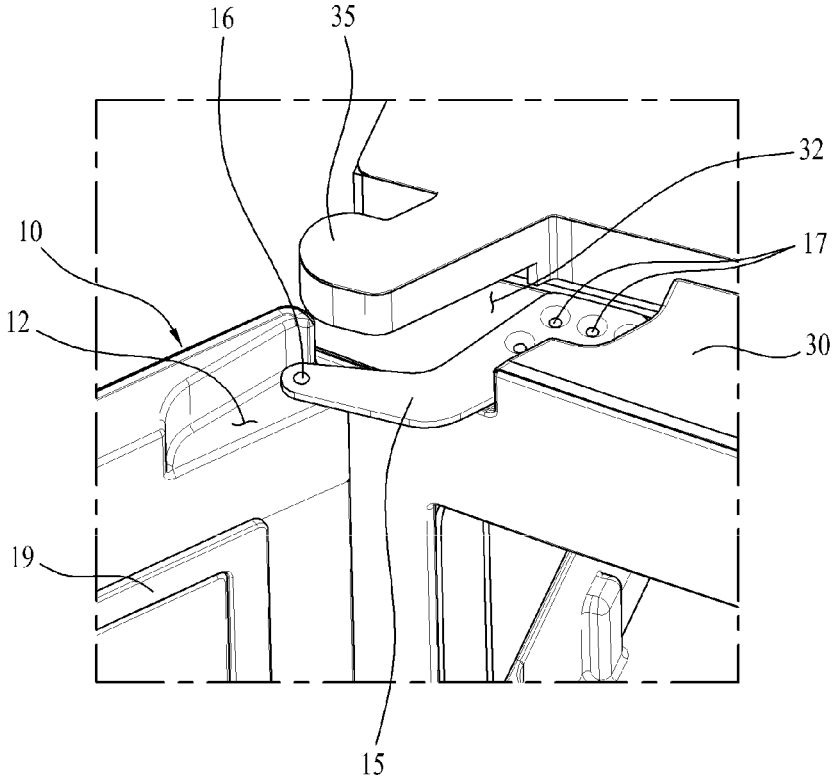
FIG. 3 is a partial perspective view enlargedly showing a hinge coupling region in FIG. 2.

FIG. 1 is a perspective view of a refrigerator according to one embodiment, FIG. 2 is a cut-away view of a refrigerator door, and FIG. 3 is a cut-away view of a door hinge. The refrigerator shown in FIGS. 1 to 3 is a bottom freezer type refrigerator, in which a refrigerator compartment is disposed at the upper portion of a cabinet 1 and a freezer compartment is disposed at the lower portion of the cabinet 1. A pair of doors 30 and 40 may be mounted at the upper front left and right sides of the cabinet 1. The doors 30 and 40 may be pivotably mounted by a pair of hinges 35 and 45, respectively, for opening and closing the refrigerator compartment.

An auxiliary storage compartment 2 may be formed at the inside of each of the main doors 30 and 40. The auxiliary storage compartment 2 may be a receiving space having a plurality of door baskets 3. A pair of auxiliary doors 10 and 20 (also referred to herein as sub doors) at the fronts of the main doors 30 and 40 may be pivotably mounted by a pair of hinges 15 and 25, respectively, for opening and closing the respective auxiliary storage compartments 2. When a user opens the auxiliary doors 10 and 20, the user may access the door baskets 3 through openings formed at the main doors 30 and 40.

A door for opening and closing the freezer compartment disposed at the lower portion of the cabinet 1 may include a pair of freezer compartment doors 50 and 60, which is pivotably mounted at the cabinet 1. In certain embodiments, the freezer compartment door may be constituted by one drawer type door.

At the inside of the auxiliary door 10 may be mounted a plurality of door baskets 13. The auxiliary door 10 may be provided at the rear thereof with a gasket 19 that extends along the edge of the auxiliary door 10 for preventing leakage of cool air through a gap between the auxiliary door 10 and the main door 30 when the auxiliary door 10 is closed.

A hook member 18 may be provided at the rear of the auxiliary door 10, which is inserted into a catching groove provided at the main door 30 such that the hook member 18 is selectively coupled into the catching groove. The user may push buttons 11 or 21 provided respectively at the fronts of the auxiliary doors 10 and 20 to separately open the auxiliary doors 10 and 20 by selectively releasing the hook member 18 from the catching groove.

Since the hook member 18 is usually coupled into the catching groove, the auxiliary doors 10 and 20 and the main doors 30 and 40 may be opened together in a state in which the auxiliary doors 10 and 20 are coupled to the main doors 30 and 40, respectively, when the user pulls handles of the auxiliary doors 10 and 20 without pressing the buttons 11 or 21. However, when the user pushes the buttons 11 or 21 and pulls the handles of the auxiliary doors 10 or 20, each of the auxiliary doors 10 or 20 may be opened separately from the main doors 30 and 40 to provide quick access to the auxiliary storage compartment 2.

As shown in FIG. 3, one end of the hinge 35 of the main door 30 may be coupled to the cabinet 1 and a pivoting shaft may be provided at the other end of the hinge 35 of the main door 30, such that the main door 30 is pivotably coupled to the pivoting shaft. The pivoting shaft may be positioned forward by an arm in the hinge. To this end, a step part 32 (or recess), to which the hinge 35 may be coupled without interference, may be formed at one end of the top of the main door 30.

In addition, one end of the hinge 15 of the auxiliary door 10 may be fastened to the step part 32 of the main door 30 by a plurality of fastening members through a plurality of fastening holes 17. A pivoting shaft 16 may be provided at the other end of the hinge 15 of the auxiliary door 10, which is positioned toward the front via an extension arm, such that the auxiliary door 10 may be pivotably coupled to the pivoting shaft 16. A step part 12, to enable the hinge 15 to be coupled without interference, may also be formed at one end of the top of the auxiliary door 10.

However, this refrigerator may have various disadvantages. The pivoting shaft 16 of the hinge 15 of the auxiliary door 10 is provided at the auxiliary door 10. For this reason, it is necessary to form the step part 12 at the upper end of the auxiliary door 10 so as to prevent interference between the hinge 15 and the auxiliary door 10 when the auxiliary door 10 is coupled to the hinge 15 and the auxiliary door 10 is pivoted.

Moreover, the pivoting shaft 16 of the hinge 15 is coupled to the top of the step part 12. In a case in which a thickness of the auxiliary door 10 is reduced to provide a low profile door, it is difficult for the pivoting shaft 16 to be securely coupled to the auxiliary door 10.

In addition, the auxiliary door 10 is pivoted and thus opened and closed in a state in which the auxiliary door 10 is coupled to the hinge 15 such that the auxiliary door 10 is supported by the hinge 15. Since the position of the pivoting shaft 16 is fixed and the auxiliary door 10 is pivoted about the pivoting shaft 16, the maximum opening angle of the auxiliary door 10 may be limited, for example, to about 100 degrees. This is because, when the auxiliary door 10 is pivoted, the auxiliary door is not pivoted any more after the outside of the auxiliary door 10 contacts the front of the main door 30.

Figure 4:
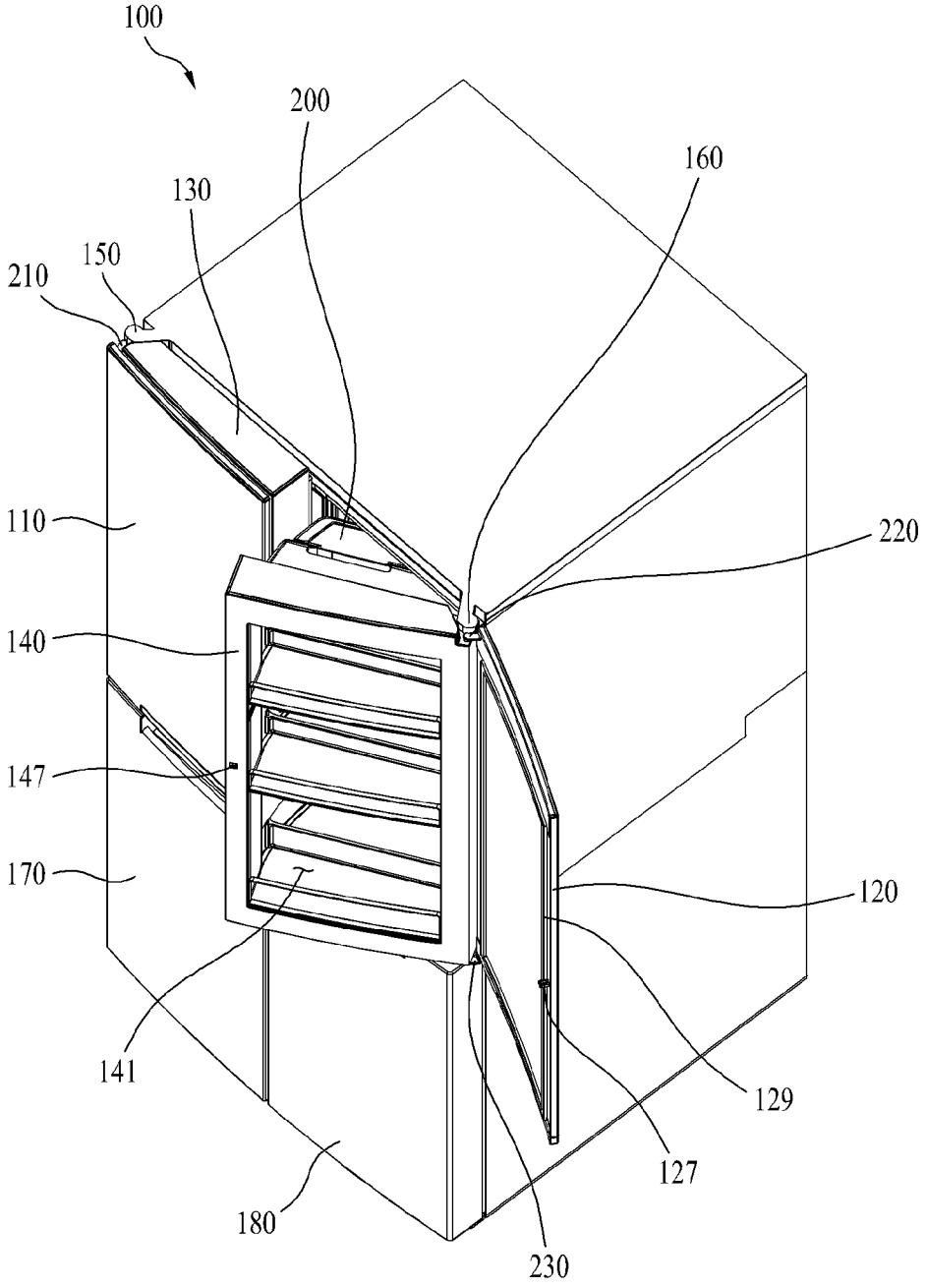
FIG. 4 is a perspective view showing a refrigerator according to the present disclosure.

FIG. 4 is a perspective view showing a refrigerator according to an embodiment that addresses these disadvantages. The refrigerator according to the present disclosure may include a cabinet 100 having a storage compartment provided therein, main doors 130 and 140 pivotably mounted at the cabinet 100 for opening and closing the storage compartment, an auxiliary storage compartment 200 mounted at the rear of each of the main doors 130 and 140, and auxiliary doors 110 and 120 (also referred to herein as sub doors) pivotably mounted at the fronts of the main doors 130 and 140 for opening and closing the auxiliary storage compartments 200.

The refrigerator shown in FIG. 4 is a bottom freezer type refrigerator, in which a refrigerator compartment is disposed at the upper portion of the cabinet 100 and a freezer compartment is disposed at the lower portion of the cabinet 100. However, the present disclosure is not limited to the bottom freezer type refrigerator, but may be applied to another type of refrigerator, such as a side-by-side type refrigerator, so long as the door for opening and closing the refrigerator compartment or the freezer compartment is a double type door including a main door and a auxiliary door.

The doors 130 and 140 for opening and closing the refrigerator compartment may be constituted by a pair of doors pivotably mounted at the left and right sides of the cabinet 100. In the same manner, doors 170 and 180 for opening and closing the freezer compartment may be constituted by a pair of doors pivotably mounted at the left and right sides of the cabinet 100.

Instead of providing a pair of doors for opening and closing the refrigerator compartment and the freezer compartment as described above, the refrigerator compartment and the freezer compartment each may be provided at the front thereof with one door. In addition, the refrigerator compartment may be constituted by a double type door, which is pivotably mounted, and the freezer compartment door may be constituted by one drawer type door, which is movable forward and backward such that the drawer type door can be withdrawn from the cabinet 100.

The main doors 130 and 140 may be constituted by a pair of left and right doors which are symmetrically formed. The main doors 130 and 140 may be pivotably mounted at opposite sides of the cabinet 100. The cabinet 100 may be provided at the left and right ends thereof with a pair of hinge brackets 150 and 160, which protrude forward (e.g., toward the front of the refrigerator). The main doors 130 and 140 may be mounted at the hinge brackets 150 and 160, respectively.

Each of the main doors 130 and 140 may be provided at the rear thereof with an auxiliary storage compartment 200. Each of the main doors 130 and 140 may be provided at the middle portion thereof with an opening 141, through which a user may access a corresponding one of the auxiliary storage compartments 200.

Each auxiliary storage compartment 200 may be provided at the rear thereof with an opening. When each of the main doors 130 and 140 is opened, therefore, the user may access a corresponding one of the auxiliary storage compartments 200 from the rear thereof.

The main doors 130 and 140 may be provided at one sides thereof with the auxiliary doors 110 and 120, which are pivotably mounted at the respective main doors 130 and 140. The auxiliary doors 110 and 120 may be mounted respectively by a pair of hinge brackets 220 and 230, which may be pivotably mounted at the upper and lower ends of the main doors 130 and 140, respectively.

The hinge brackets 220 mounted respectively at the upper ends of the main doors 130 and 140 may be referred to as upper hinge brackets and the hinge brackets 230 mounted respectively at the lower ends of the main doors 130 and 140 may be referred to as lower hinge brackets.

For ease of description, the hinge brackets 150 and 160 mounted respectively at the main doors 130 and 140 may be referred to herein as first hinge brackets and the hinge brackets 220 and 230 coupled respectively to the auxiliary doors 110 and 120 may be referred to as second hinge brackets.

The second hinge brackets 220 and 230 may be fixed to the auxiliary doors 110 and 120, and the pivoting shafts provided at the front ends of the second hinge brackets 220 and 230 may be pivotably mounted at the main doors 130 and 140. Consequently, the second hinge brackets 220 and 230 may pivot relative to the main doors 130 and 140 together with the auxiliary doors 110 and 120.

Meanwhile, the auxiliary doors 110 and 120 may be provided at the rear thereof with hook members 127 protruding towards the main doors 130 and 140. The main doors 130 and 140 may be provided at one sides thereof with catching grooves 147. The hook members 127 may be inserted and selectively coupled to the catching grooves 147.

The hook members 127 and the catching grooves 147 may remain coupled to each other and the coupling between the hook members 127 and the catching grooves 147 may be selectively released by a user. Consequently, the auxiliary doors 110 and 120 may be opened in a state in which the auxiliary doors 110 and 120 are coupled to the main doors 130 and 140, respectively, or only the auxiliary doors 110 and 120 may be opened separatedly from the main doors 130 and 140.

In the refrigerator according to the present disclosure, a pair of refrigerator compartment doors may be provided in a symmetric fashion. In the following description, therefore, only the right side door will be described. However, the description of the right side door may be applied to the left side door unless described otherwise.

The auxiliary door 120 may be provided at the rear thereof with a gasket 129 contacting the outside of the opening 141 at the front of the main door 140 along the edge of the auxiliary door 120. The gasket 129 may prevent leakage of cool air through a gap between the auxiliary door 120 and the main door 140 when the auxiliary door 120 is closed. A gasket that contacts the front of the cabinet 100 may also be provided at the rear of the main door 140.

Figure 5:
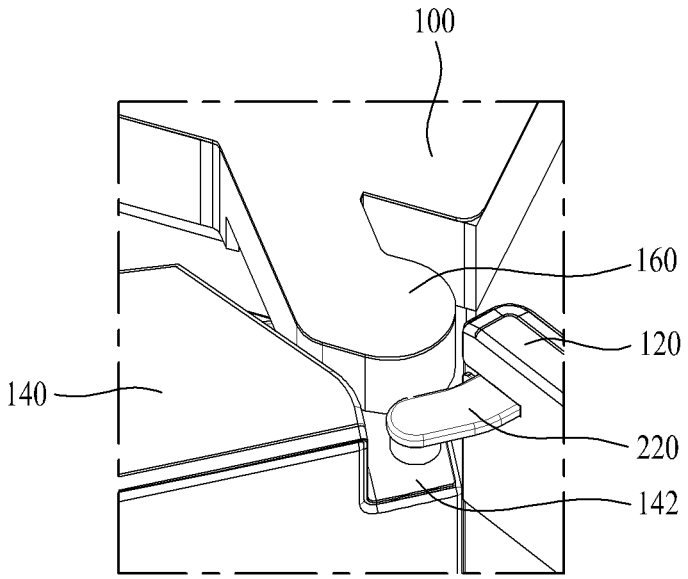
FIG. 5 is a partial perspective view showing an upper hinge coupling region of a right side refrigerator compartment door in FIG. 4.
Figure 6:
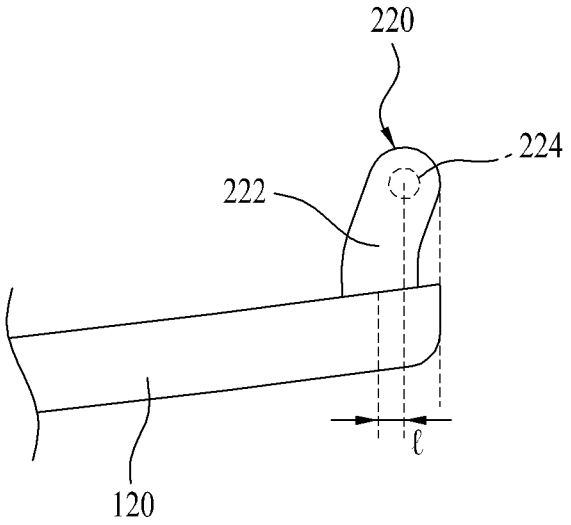
FIG. 6 is an enlarged plan view showing a second hinge bracket.
Figure 7:
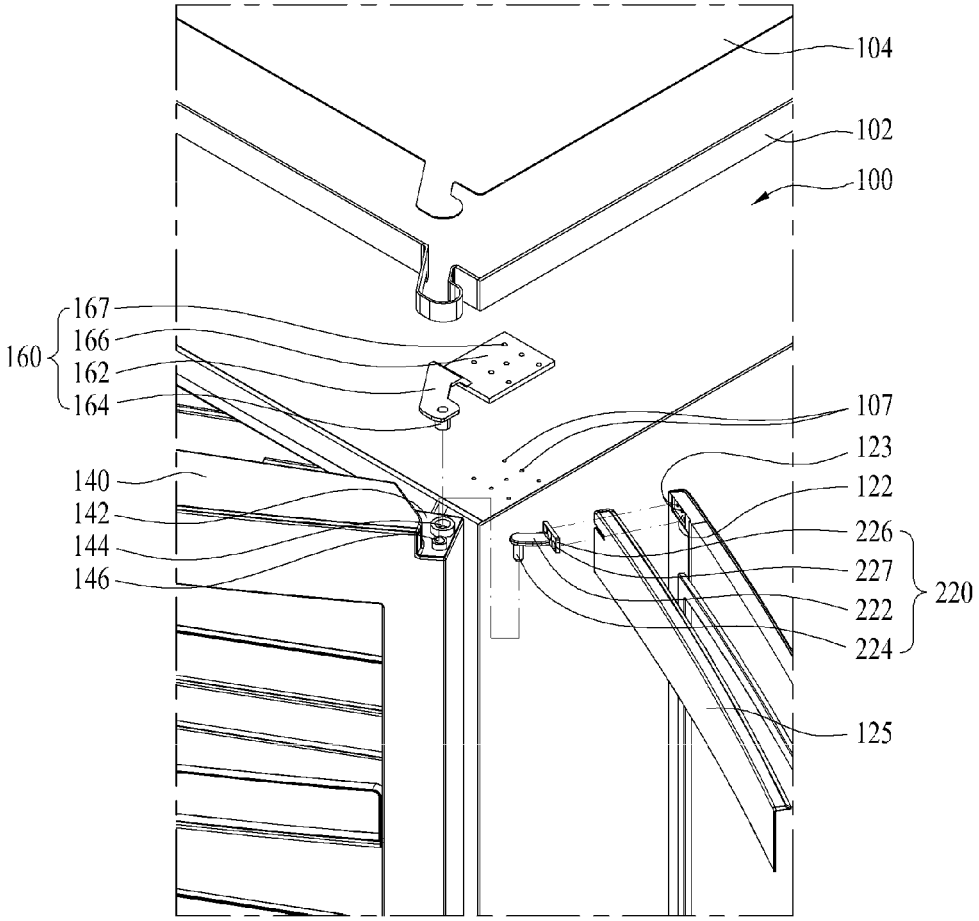
FIG. 7 is an exploded perspective view showing the upper hinge coupling region of the right side refrigerator compartment door in FIG. 4.

FIG. 5 is a partial perspective view showing an upper hinge coupling region of the door, FIG. 6 is an enlarged plan view showing the second hinge bracket, and FIG. 7 is an exploded perspective view showing the upper hinge coupling region of the right side refrigerator compartment door.

As shown in FIG. 5, the main door 140 may be mounted at the first hinge bracket 160 such that the main door 140 can be pivoted by a predetermined angle and the auxiliary door 120 may be pivotably mounted at the second hinge bracket 220.

As shown in FIG. 7, the first hinge bracket 160 may be provided at the front end thereof with a first hinge rotation shaft 164, which is shaft-coupled to the main door 140. The first hinge rotation shaft 164 may be vertically provided. The rotation shaft may protrude from the body of the hinge bracket, and may also be referred to herein as a rotation axis or pin.

The first hinge bracket 160 may include a fastening part 166 fastened and coupled to the top of the cabinet 100 through a plurality of fastening holes 167, an extension part 162 extending forward from the fastening part 166, and the rotation shaft 164 vertically protruding from an end of the extension part 162.

The extension part 162 may extend upward from the fastening part 166, be bent at a predetermined height, and then extend forward. Consequently, the lower end of the rotation shaft 164 may be formed such that the height of the lower end of the rotation shaft 164 is similar in height to the bottom of the fastening part 166.

The first hinge bracket 160 may be integrally formed of a metal material such that the first hinge bracket 160 exhibits sufficient strength. Moreover, the cabinet 100 may be provided at the top thereof with a plurality of fastening holes 107 corresponding to the fastening holes 167 formed at the fastening part 166 of the first hinge bracket 160.

Meanwhile, the cabinet 100 may be provided at the top thereof with a cover for receiving the first hinge bracket 160 such that the first hinge bracket 160 cannot be seen from the outside. As shown in FIG. 7, the cover may include a side cover 102 mounted along the edge of the top of the cabinet 100 while having a predetermined height for receiving the first hinge bracket 160 and a top cover 104 coupled to the side cover 102 for covering the top of the side cover 102.

The second hinge bracket 220 may include a fastening part 226 fastened to the rear of the auxiliary door 120 through a plurality of fastening holes 227 such that the fastening part 226 may be coupled to the rear of the auxiliary door 120, an extension part 222 extending backward from the fastening part 226, and a rotation shaft 224 vertically formed at an end of the extension part 222. The fastening part 226 may be formed at the rear of the auxiliary door 120 such that the fastening part 226 is bent in a direction parallel to the rear of the auxiliary door 120.

The auxiliary door 120 of the refrigerator according to the present disclosure may be thinner than that of a conventional refrigerator. The conventional auxiliary door may have a thickness equivalent to about ½ that of the main door, whereas the auxiliary door according to the present disclosure may have a thickness equivalent to ⅓ or less that of the main door 140.

In this case, the fastening part 226 may be formed at the rear of the auxiliary door 120 in parallel to the rear of the auxiliary door 120 since it is difficult to securely fasten and fix the second hinge bracket 220 to the top of the auxiliary door 120 using a plurality of fastening members when the thickness of the auxiliary door 120 is reduced.

The auxiliary door 120 may be provided at the rear thereof with a fastening groove part 122, which may be formed in a concave shape, corresponding to the fastening part 226. A plurality of fastening holes 123 corresponding to the fastening holes 227 of the fastening part 226 may be provided at the fastening groove part 122.

A cover 125 for covering the fastening part 226 of the second hinge bracket 220 such that the fastening part 226 cannot be seen may be coupled to the rear of the auxiliary door 120. A slit, into which the extension part 222 is inserted, may be formed at the cover 125. The second hinge bracket 220 may be integrally formed of a metal material such that the second hinge bracket 220 exhibits sufficient strength.

The main door 140 may be provided at the upper end thereof with a step part 142 (or recess), which may be formed in a concave shape, in which the rotation shaft 164 of the first hinge bracket 160 and the rotation shaft 224 of the second hinge bracket 220 are mounted. The step part 142 may be formed such that the first hinge bracket 160 and the second hinge bracket 220 do not interfere with each other when the first hinge bracket 160 and the second hinge bracket 220 are shaft-coupled to each other and pivoted.

The step part 142 may be provided at the top thereof with a first shaft hole 144, into which the rotation shaft 164 of the first hinge bracket 160 is inserted, and a second shaft hole 146, into which the rotation shaft 224 of the second hinge bracket 220 is inserted. The first shaft hole 144 and the second shaft hole 146 each may be formed in the shape of a boss protruding upward from the top of the step part 142.

The second shaft hole 146 may be disposed at the front side of the first shaft hole 144. Consequently, the second hinge rotation shaft 224 may be coupled more adjacent to the front of the main door 140 than the first hinge rotation shaft 164.

In addition, the first shaft hole 144 and the second shaft hole 146 may be disposed adjacent to a side end of the step part 142. When pivoted, the main door 140 may be pivoted until the side of the main door 140 contacts the edge of the side end of the front of the cabinet 100. Moreover, when pivoted, the auxiliary door 120 may also be pivoted until the side of the auxiliary door 120 contacts the side of the main door 140. Consequently, the nearer the first hinge rotation shaft 164 and the second hinge rotation shaft 224 are to the side of the main door 140, the larger the maximum opening angles of the main door 140 and the auxiliary door 120 may be.

In addition, the second hinge bracket 220 may be formed such that the second hinge bracket 220 is inclined inwardly from the rotation shaft 224 to the end of the extension part 222 on the side of the fastening part 226. For example, as shown in FIG. 6, the extension part 222 may be angled such that the center of the end of the extension part 222 on the side of the fastening part 226 is offset toward the left side (e.g., toward the center of the door) from the center of the rotation shaft 224 by a distance I. In this way, the rotation shaft 224 may be positioned closer to the edge of the auxiliary door 120. Therefore, as shown in FIG. 5, the pivoting angle of the second hinge bracket 220 at which the second hinge bracket 220 contacts the front of the first hinge bracket 160 may be increased when the auxiliary door 120 is opened.

Figure 8:
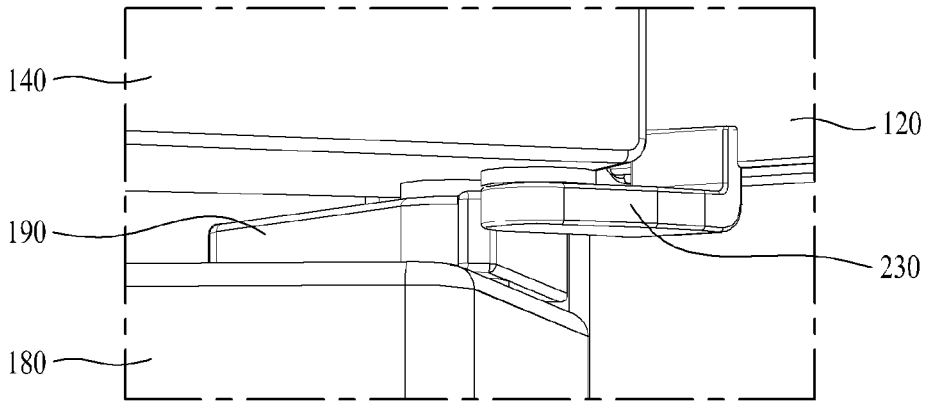
FIG. 8 is a partial perspective view enlargedly showing a lower hinge coupling region of the right side refrigerator compartment door.
Figure 9:
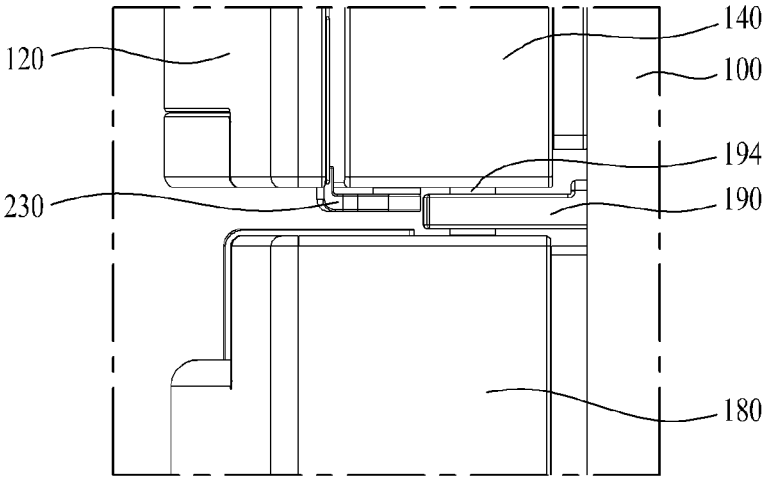
FIG. 9 is a right side view showing the lower hinge coupling region of the right side refrigerator compartment door.
Figure 10:
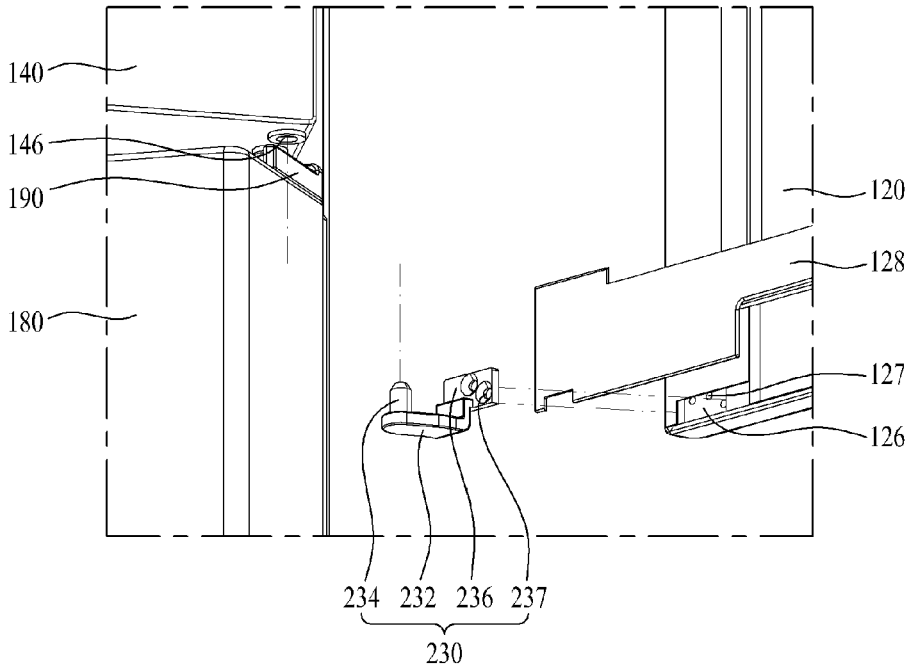
FIG. 10 is an exploded perspective view showing the lower hinge coupling region of the right side refrigerator compartment door.

FIG. 8 is a partial perspective view showing a lower hinge coupling region of the right side refrigerator compartment door, FIG. 9 is a right side view showing the lower hinge coupling region of the right side refrigerator compartment door of FIG. 8, and FIG. 10 is an exploded perspective view showing the lower hinge coupling region of the right side refrigerator compartment door of FIG. 8.

A first lower hinge bracket 190 may be fastened and fixed to the front of the cabinet 100 at a position between the refrigerator compartment door main door 140 and the freezer compartment door 180. The first hinge bracket 160 may be fastened and fixed to the top of the cabinet 100, whereas the first lower hinge bracket 190 may be fastened and fixed to the front of the cabinet 100. The first hinge bracket 160 may be referred to as a first upper hinge bracket with respect to the first lower hinge bracket 190.

A rotation shaft 194 (also referred to as a rotation axis or pin) of the first lower hinge bracket 190 may be shaft-coupled to the lower portion of the main door 140 for pivotably supporting the main door 140. In addition to the main door 140, the freezer compartment door 180, which is disposed under the main door 140, may be shaft-coupled to the first lower hinge bracket 190.

The second lower hinge bracket 230, pivotably mounted at the bottom of the main door 140, may be fastened and fixed to the lower end of the rear of the auxiliary door 120. The second lower hinge bracket 230 may include a fastening part 236 fastened to the rear of the auxiliary door 120 through a plurality of fastening holes 237, an extension part 232 extending backward from the fastening part 236, and a rotation shaft 234 vertically formed at an end of the extension part 232. The fastening part 236 may be formed as a plate. Moreover, the extension part 232 may be referred to as an extension arm.

The extension part 232 may extend downward from the fastening part 236, be bent backward, and then extend backward, instead of directly extending horizontally backward from the fastening part 236. Unlike the upper end of the main door 140, a step part may not be formed at the lower end of the main door 140, and the lower end of the auxiliary door 120 and the lower end of the main door 140 may have the same height. For this reason, the extension part 232 may be bent downward such that the second lower hinge bracket 230 coupled to the rear of the auxiliary door 120 can be shaft-coupled to the bottom of the main door 140.

The main door 140 may be provided at the bottom thereof near the front and the side thereof with a shaft hole 146, for mounting the rotation shaft 234. The auxiliary door 120 may be provided at the rear thereof with a fastening groove part 126, which may be formed in a concave shape, corresponding to the fastening part 236. Moreover, a plurality of fastening holes 127 corresponding to the fastening holes 237 of the fastening part 236 may be provided at the fastening groove part 126.

A cover 128 for covering the fastening part 236 of the second lower hinge bracket 230 such that the fastening part 236 cannot be seen may be coupled to the rear of the auxiliary door 120. A slit, through which the extension part 232 extends, may be formed at the cover 128. The second lower hinge bracket 230 may be integrally formed of a metal material such that the second lower hinge bracket 230 exhibits sufficient strength.

In addition, the auxiliary door 120 may include an outer case forming the front thereof, a door liner forming the rear thereof, and a space in the case defined by the outer case and the door liner, the space being evacuated to form a vacuum insulation space. The outer case may form the front of the door and the door liner may form the rear of the door.

In a general refrigerator door, an insulating material, such as polyurethane, is injected and foamed in a space defined by the outer case and the door liner such that the refrigerator door is insulated. It is necessary for the foamed insulating material to have a predetermined thickness or more such that the foamed insulating material exhibits a sufficient insulation effect. For this reason, it is difficult for the door formed by injecting the foamed insulating material thereinto to have a thin thickness.

In contrast, the outer case and the door liner may be formed of a metal sheet and welded to each other such that an empty space is defined between the outer case and the door liner, and then the space is evacuated and sealed to form a vacuum insulation space. At this time, it is necessary for the outer case and the door liner to have a structure which does not deform due to the vacuum pressure since the outer case and the door liner are manufactured in the form of a relatively wide sheet. Consequently, a plurality of support parts functioning as a spacer may be disposed between the outer case and the door liner. In addition, reinforcement ribs may be formed at the inside of the sheet for preventing deformation of the sheet due to vacuum pressure.

In a case in which the vacuum insulation space is formed in the door of the refrigerator, however, it may be difficult to maintain a high vacuum state over time after the door of the refrigerator is manufactured in addition to having reinforcement of the structural strength as described above. A pressure level of the vacuum may be lowered over time due to various causes, such as materials (e.g., plastic support parts) disposed in the vacuum insulation space and gas generated from the surface of the metal sheet. A getter for absorbing gas generated in the vacuum space may be installed so as to solve the above problems.

In a case in which the door having the vacuum insulation space defined therein is used as described above, it is possible to manufacture the auxiliary door such that the auxiliary door has a considerably thin thickness and, therefore, it is possible to increase the internal storage space of the refrigerator.

Meanwhile, the auxiliary door may include a case having a predetermined space defined therein and open cell polyurethane foam injected into the space. The space may be sealed after the polyurethane foam is injected and foamed in the space and the space is evacuated.

Open cells may generally be formed by the polyurethane foam provided in the space. The open cells do not mean independent cells isolated from the outside but means cells for forming an open space communicating with another space.

The case of the auxiliary door may have a space defined therein, into which a foam liquid for forming open cell polyurethane foam may be injected. The case may be provided at one side thereof with a hole, through which the foam liquid may be injected. The foam liquid may be injected through the hole and then cooled to form open cell polyurethane foam.

The open cell polyurethane foam may constitute the core of a vacuum insulating material. The open cell polyurethane foam may exhibit low thermal conductivity for a long period of time. In addition, the polyurethane foam may form cells having a high cell opening rate and a relatively small size such that the polyurethane foam exhibits efficient insulating performance even in a relatively low degree of vacuum.

To this end, a reactive cell opener composition including a base oil, such as a silicone oil surface active agent, and a metal salt of a fatty acid containing a hydroxyl group capable of reacting with an isocyanate group may be added to the foam liquid. A metal salt of a fatty acid may be obtained by reaction between a fatty acid and a metal hydroxide.

In addition, the open cell polyurethane foam may be a polyol composition including a polyol and a cell opener. A polyol composition, which is a metal salt of a fatty acid containing a hydroxyl group capable of reacting with an isocyanate group, may be added to the cell opener.

In order to stabilize cells generated during foam reaction and adjust opening of the cells, a foam stabilizer including one ingredient or a mixture of two or more ingredients may be included. For example, the foam stabilizer may be a base oil of a reactive cell opener composition previously described as a silicone-based surface active agent.

The auxiliary door 120 may be manufactured by injecting a foam liquid into the inner space of the case through the hole to form open cell polyurethane foam, evacuating the inner space of the case through the hole, and closing the hole. Before the foam liquid is injected into the inner space of the case, the getter may be inserted.

The open cell polyurethane foam may function to reinforce the strength of the vacuum insulation space in the door such that the vacuum insulation space in the door is not deformed due to vacuum pressure in the case and, in addition, as an insulating material.

In addition, as the space formed by the open cells may be formed as a vacuum space, it may be possible to achieve insulating performance equivalent to two or more times than that of a conventional polyurethane foam door. Furthermore, since the inner space of the open cell polyurethane foam is formed as a vacuum insulation space, it may be possible to exhibit sufficient insulating performance even when the door is manufactured such that the door has a very thin thickness.

FIGS. 11A to 11D are plan views illustrating states in which the main door and the auxiliary door mounted at the two hinge brackets are opened and closed. As described above, the auxiliary storage compartment 200 may be mounted at the rear of the main door 140 such that the auxiliary storage compartment 200 moves together with the main door 140.

Figure 11A:
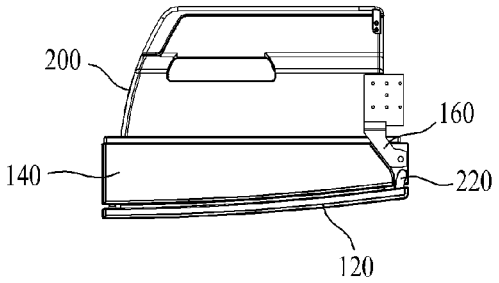
FIGS. 11A to 11D are plan views showing opening and closing or movement of a main door, a auxiliary door, and an auxiliary storage compartment of the right side refrigerator compartment.
Figure 11B:
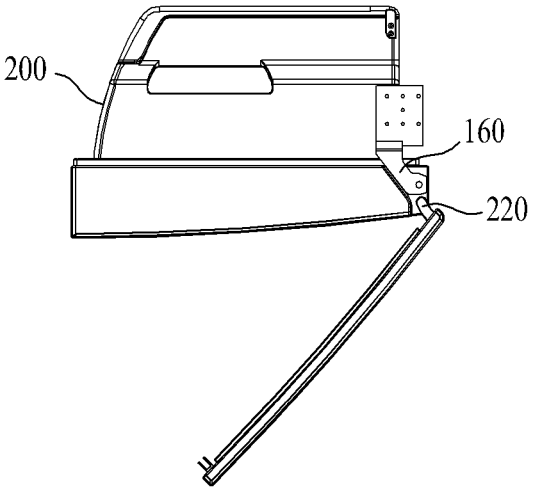

When both of the main door 140 and the auxiliary door 120 are closed as shown in FIG. 11A, a user may push a button provided at the auxiliary door 120 to open only the auxiliary door 120 as illustrated in FIG. 11B.

Figure 11C:
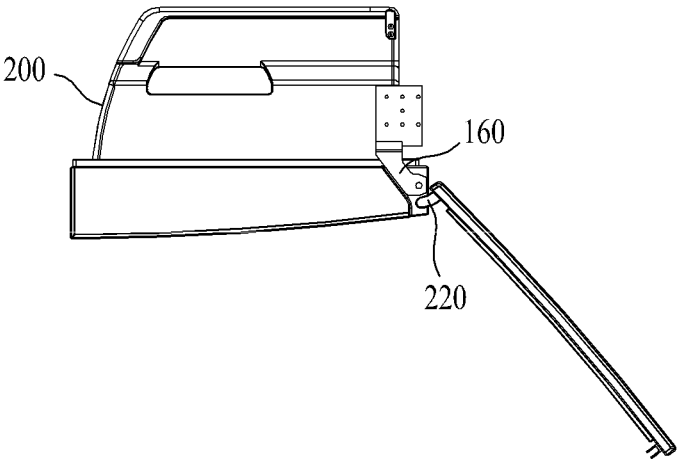

When the user pivots the auxiliary door 120 as shown in FIG. 11C, the auxiliary door 120 may be pivoted until the side of the second hinge bracket 220 contacts the side of the first hinge bracket 160 or the side of the auxiliary door 120 contacts the side of the main door 140. Hence, a range of motion of the auxiliary door 120 may be increased.

In the present disclosure, the auxiliary door 120 may be rotated by an angle of about 135 degrees with respect to the main door 140. The pivoting angle of the auxiliary door 120 may be greater than a pivoting angle of a auxiliary door in a conventional refrigerator, which may be about 100 degrees.

On the other hand, when the user pulls a handle of the auxiliary door 120 without pushing the button, the auxiliary door 120 may be pivoted about the first hinge bracket 160 and opened in a state in which the auxiliary door 120 is coupled to the main door 140.

Figure 11D:
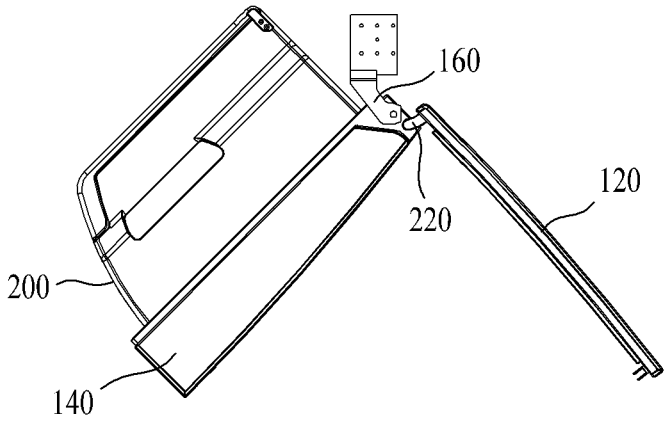

In addition, the main door 140 may be pulled such that the main door 140 is pivoted in a state in which the auxiliary door 120 is opened first as shown in FIG. 11D. As this time, the main door 140 may be opened to an angle of about 100 degrees and the auxiliary door 120 may be pivoted relative to the main door 140. Consequently, the auxiliary door 120 may be further pivoted until the auxiliary door 120 contacts the cabinet 100.

As is apparent from the above description, the refrigerator according to the present disclosure may have an effect in that, in a case in which the refrigerator has a double door structure, it is possible to securely fasten the hinge bracket to an auxiliary door which has a thin thickness.

In addition, the refrigerator according to the present disclosure may have an effect in that it is possible to greatly increase an opening angle of the auxiliary door with respect to the main door.

Furthermore, the refrigerator according to the present disclosure may have an effect in that the inner space of the door is formed as a vacuum insulation space, whereby the door exhibits high insulating performance while having a thin thickness.

In addition, the refrigerator according to the present disclosure may have an effect in that open cell polyurethane foam is formed in the inner space of the door, whereby the door exhibits higher insulating performance.

As embodied and broadly described herein, the present disclosure provides a refrigerator that may include a cabinet having a storage compartment provided therein, a main door pivotably mounted at the cabinet for opening and closing the storage compartment, an auxiliary storage compartment mounted at a rear of the main door, a auxiliary door pivotably mounted at a front of the main door for opening and closing the auxiliary storage compartment, a first hinge bracket fixed to an upper end of the cabinet, a rotation shaft of the first hinge bracket being positioned on an upper portion of the main door, and a second hinge bracket fixed to an upper portion of the auxiliary door, a rotation shaft of the second hinge bracket being positioned on the upper portion of the main door, wherein the rotation shaft of the second hinge bracket is positioned more forward than the rotation shaft of the first hinge bracket.

The second hinge bracket may be formed such that the rotation shaft of the second hinge bracket is positioned more forward than the rotation shaft of the first hinge bracket.

The refrigerator may further include a first lower hinge bracket fixed to a lower end of the cabinet, a rotation shaft of the first lower hinge bracket being positioned on a lower portion of the main door, and a second lower hinge bracket fixed to a lower portion of the auxiliary door, a rotation shaft of the second lower hinge bracket being positioned on the lower portion of the main door.

The second hinge bracket may be mounted at an inside of the auxiliary door through a fastening part formed at a rear of the auxiliary door such that the fastening part is bent in a direction parallel to the rear of the auxiliary door.

The auxiliary door may include a cover coupled to the rear thereof for covering the fastening part.

The second hinge rotation shaft may be mounted at a step part formed at a corner of an upper end of the main door in a concave shape.

The main door may be provided at a middle portion thereof with an opening configured to be opened and closed by the auxiliary door.

The auxiliary door may be provided at a rear thereof with a gasket for sealing a gap defined between the auxiliary door and the main door.

The auxiliary door may have a thickness equivalent to ⅓ or less that of the main door.

The auxiliary door may include an outer case forming a front part thereof, a door liner forming a rear part thereof, and a space in the case defined by the outer case and the door liner, the space being evacuated to form a vacuum insulation space.

The auxiliary door may include a case having a predetermined space defined therein and open cell polyurethane foam injected into the space, and the space may be sealed after the polyurethane foam is injected and foamed in the space and the space is evacuated.

In another aspect of the present disclosure, there is provided a refrigerator which may include a cabinet having a storage compartment provided therein, a main door pivotably mounted at the cabinet for opening and closing the storage compartment, an auxiliary storage compartment mounted at an opening provided at an inside edge of the main door, a auxiliary door pivotably mounted at a front of the main door for opening and closing the opening, a first hinge bracket fixed to a corner of the cabinet, a rotation shaft of the first hinge bracket being positioned on a top or a bottom of the main door, and a second hinge bracket comprising a fastening part fixed to a rear of the auxiliary door in parallel to the rear of the auxiliary door and an extension part extending from the fastening part toward the main door, a rotation shaft of the second hinge bracket being positioned on the top or the bottom of the main door, wherein the second hinge bracket is formed such that the second hinge bracket is inclined inwardly from the rotation shaft of the second hinge bracket with respect to an inside of the auxiliary door at a predetermined angle.

The rotation shaft of the second hinge bracket may be positioned more forward than the rotation shaft of the first hinge bracket.

The auxiliary door may include a fastening groove, into which the fastening part of the second hinge bracket is coupled, and a cover for covering the fastening groove.

The rotation shaft of the second hinge bracket may be mounted at a step part formed at a corner of an upper end of the main door in a concave shape.

The auxiliary door may be provided at a rear thereof with a gasket for sealing a gap defined between the auxiliary door and an edge of the front of the main door.

The auxiliary door may have a thickness equivalent to ⅓ or less that of the main door.

The auxiliary door may include an outer case forming a front part thereof, a door liner forming a rear part thereof, and a space in the case defined by the outer case and the door liner, the space being evacuated to form a vacuum insulation space.

The auxiliary door may include a case having a predetermined space defined therein and open cell polyurethane foam injected into the space, and the space may be sealed after the polyurethane foam is injected and foamed in the space and the space is evacuated.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage compartment provided therein;

a main door that opens and closes the storage compartment, the main door having an access opening;

an auxiliary storage compartment provided on the main door;

an auxiliary door that opens and closes the access opening of the main door;

a first hinge bracket fixed to an upper end of the cabinet, the first hinge bracket including a first fastening part fastened to an upper surface of the cabinet to fix the first hinge bracket to the upper end of the cabinet, a first extension part that extends forward from the first fastening part to the main door, and a first rotation shaft that extends from the first extension part and is coupled to an upper portion of the main door to form a rotational axis of the main door;

a second hinge bracket fixed to an upper portion of the auxiliary door, the second hinge bracket including a second fastening part fastened to the auxiliary door, a second extension part that extends backward from the second fastening part to the main door, and a second rotation shaft that extends from the second extension part and is coupled to the upper surface of the main door to form a rotation axis of the auxiliary door, wherein the rotation axis of the auxiliary door is provided in front of the rotational axis of the main door;

a first shaft hole provided on the upper surface of the main door and coupled to the first rotation shaft; and a second shaft hole provided in front of the first shaft hole on the upper surface of the main door and coupled to the second rotation shaft, wherein the first shaft hole and the second shaft hole are mounted at a recess formed at an upper corner region of the main door, the recess having a stepped shape.

2. The refrigerator according to claim 1, wherein each of the first extension part and the second extension part extends laterally outward from each of the first fastening part and the second fastening part when the main door and the auxiliary door are closed.

3. The refrigerator according to claim 1, further comprising:

a first lower hinge bracket fixed to a lower end of the cabinet, the first lower hinge bracket including a third rotation shaft that is coupled to a lower portion of the main door; and a second lower hinge bracket fixed to a lower portion of the auxiliary door, a rotation axis of the second lower hinge bracket being positioned on the lower portion of the main door.

4. The refrigerator according to claim 1, wherein the second fastening part of the second hinge bracket is bent in a direction parallel to a back surface of the auxiliary door and fastened to the back surface of the auxiliary door at a position below an upper surface of the auxiliary door.

5. The refrigerator according to claim 1, wherein the auxiliary door includes:

a fastening groove provided on a back surface of the auxiliary door at a position below an upper surface of the auxiliary door to couple the second fastening part of the second hinge bracket to the auxiliary door, wherein the second fastening part of the second hinge bracket is inserted in the fastening groove; and a cover coupled to the back surface of the auxiliary door to cover the fastening groove and the second fastening part, the cover having a slit such that the second extension part passes through the slit as the second extension part extends outward from the second fastening part.

6. The refrigerator according to claim 1, wherein the second rotation shaft is mounted at the recess formed at the upper corner region of the main door.

7. The refrigerator according to claim 1, wherein the auxiliary door includes a gasket that seals a gap between the auxiliary door and the main door.

8. The refrigerator according to claim 1, wherein the auxiliary door has a thickness that is ⅓ or less than a thickness of the main door.

9. The refrigerator according to claim 8, wherein the auxiliary door includes:

an outer case that forms a front portion of the auxiliary door;

a door liner that forms a rear portion of the auxiliary door; and a space formed between the outer case and the door liner, the space being a vacuum insulation space.

10. The refrigerator according to claim 8, wherein the auxiliary door includes:

a case having a prescribed space defined therein; and an open cell polyurethane foam injected into the space, wherein the space is vacuum sealed after the polyurethane foam is injected and foamed in the space.

11. The refrigerator according to claim 1, wherein a circumference of the first shaft hole is larger than a circumference of the second shaft hole, and the recess is shaped to accommodate respective circumferences of the first shaft hole and the second shaft hole.

12. The refrigerator according to claim 1, wherein a size of the first hinge bracket is larger than a size of the second hinge bracket, and a height of the first hinge bracket in the recess on the upper surface of the main door is higher than a height of the second hinge bracket in the recess on the upper surface of the main door.

13. The refrigerator according to claim 1, further comprising:

a side cover mounted along an edge of a top of the cabinet having a predetermined height to receive the first hinge bracket; and a top cover coupled to the side cover to cover a top of the side cover, the side cover and the top cover each having a shape that corresponds to a shape of the first hinge bracket such that the first hinge bracket is hidden from view.

14. The refrigerator according to claim 1, wherein the recess is configured to provide a space for the first extension part and the second extension part such that the first extension part and the second extension part do not interfere with the main door when rotating, and wherein the first extension part extends upward from the first fastening part and is bent at predetermined height such that a height of a lower end of the first rotation shaft is a similar to a height of a bottom of the first fastening part.

15. A refrigerator comprising:

a cabinet having a storage compartment provided therein;

a main door that opens and closes the storage compartment, the main door having an access opening;

an auxiliary storage compartment provided at the access opening formed around an inside edge of the main door;

an auxiliary door pivotably mounted over a front of the main door that opens and closes the access opening;

a first hinge bracket fixed to a corner of the cabinet, the first hinge bracket including a first fastening part fastened to an upper or lower surface of the cabinet to fix the first hinge bracket to an upper or lower end of the cabinet, a first extension part that extends forward from the first fastening part to the main door, and a first rotation shaft coupled to a top surface or a bottom surface of the main door to form a rotational axis of the main door;

a second hinge bracket fixed to an upper portion or lower portion of the auxiliary door, the second hinge bracket including a second fastening part bent in a direction parallel to a back surface of the auxiliary door and fastened to the back surface of the auxiliary door, a second extension part that extends backward from the second fastening part to the main door, and a second rotation shaft coupled to the top surface or the bottom surface of the main door to form a rotation axis of the auxiliary door, wherein the rotation axis of the auxiliary door is provided in front of the rotational axis of the main door; and a first shaft hole and a second shaft hole provided on the top surface or the bottom surface of the main door, wherein the first rotation shaft is coupled in the first shaft hole and the second rotation shaft is provided in front of the first shaft hole on the top surface or the bottom surface of the main door and coupled in the second shaft hole, and wherein each of the first extension part and the second extension part extends laterally outward from each of the first fastening part and the second fastening part, respectively, when the main door and the auxiliary door are closed, wherein the first shaft hole and the second shaft hole are mounted at a recess formed at an upper corner end of the main door, the recess having a stepped shape and providing a space for the first extension part and the second extension part such that the first extension part and the second extension part do not interfere with the main door when rotating.

16. The refrigerator according to claim 15, wherein the auxiliary door includes:

a fastening groove provided on the back surface of the auxiliary door at a position below an upper surface of the auxiliary door to couple the second fastening part of the second hinge bracket to the auxiliary door, wherein the second fastening part of the second hinge bracket is inserted in the fastening groove; and a cover coupled to the back surface of the auxiliary door to cover the fastening groove and the second fastening part, the cover having a slit through which the second extension part is inserted.

17. The refrigerator according to claim 15, wherein the second rotation shaft of the second hinge bracket is mounted in the recess formed at the upper corner end of the main door.

18. The refrigerator according to claim 15, wherein the auxiliary door includes a gasket that seals a gap between the auxiliary door and an edge of a front side of the main door.

19. The refrigerator according to claim 15, wherein the auxiliary door has a thickness that is ⅓ or less than a thickness of the main door.

20. The refrigerator according to claim 19, wherein the auxiliary door includes:

an outer case that forms a front portion of the auxiliary door;

a door liner that forms a rear portion of the auxiliary door; and a space formed between the outer case and the door liner, the space being a vacuum insulation space.

21. The refrigerator according to claim 19, wherein the auxiliary door includes:

a case having a prescribed space defined therein; and an open cell polyurethane foam injected into the space, wherein the space is vacuum sealed after the polyurethane foam is injected and foamed in the space.

* * * * *